US005704083A

United States Patent [19]

Nerg

[11] Patent Number: 5,704,083

[45] Date of Patent: Jan. 6, 1998

[54] PATIENT BED HAVING VERTICALLY MOVEABLE MATTRESS

[76] Inventor: Kari Nerg, Hallakoskentie 113, FIN-16500 Luhtikylä , Finland

[21] Appl. No.: 592,398

[22] PCT Filed: Jul. 20, 1994

[86] PCT No.: PCT/FI94/00327

§ 371 Date: Feb. 1, 1996

§ 102(e) Date: Feb. 1, 1996

[87] PCT Pub. No.: WO95/03767

PCT Pub. Date: Feb. 9, 1995

[30] Foreign Application Priority Data

Aug. 2, 1993 [FI] Finland ..... 933445

[51] Int. Cl.[6] ..... A61G 7/047

[52] U.S. Cl. ..... 5/600; 5/934; 5/606; 5/617

[58] Field of Search ..... 5/600, 606, 617, 5/613, 937, 934, 928

[56] References Cited

U.S. PATENT DOCUMENTS

| | | | |
|---|---|---|---|
| 1,582,419 | 4/1926 | Murphy | 5/600 |
| 2,112,702 | 3/1938 | Loibl | 5/937 |
| 3,945,063 | 3/1976 | Matsuura | 5/616 |
| 5,233,712 | 8/1993 | Jurus | 5/613 |

FOREIGN PATENT DOCUMENTS

| | | | |
|---|---|---|---|
| 1461273 | 12/1966 | France | 5/600 |
| 625296 | 12/1962 | Netherlands | 5/934 |
| 2154437 | 9/1985 | United Kingdom | 5/613 |

*Primary Examiner*—Flemming Saether
*Attorney, Agent, or Firm*—Kubovcik & Kubovcik

[57] ABSTRACT

A patient bed including castors (1) resting against the floor, legs or a base frame, and a bed framework (2) and a mattress (3), the mattress further including a number of elongated mattress elements (3', 3", etc.), aligned parallel in the longitudinal direction of the bed, and the bed framework being made of a framing of the patient bed to which framing are attached tubes (8) or similar slats, aligned parallel with the mattress elements of the bed and forming an essentially horizontal plane in which each tubular slat is aligned in the crosswise or longitudinal direction of the bed to essentially coincide with a furrow adapted between the mattress elements. The invention is implemented so that the patient bed is provided with means (5–7) for moving the mattress (3) essentially in the vertical direction between a first plane defined by the tubular slats and a second plane below the first plane and for stopping the mattress at a desired elevation between the two planes.

4 Claims, 2 Drawing Sheets

PATIENT BED HAVING VERTICALLY MOVEABLE MATTRESS

BACKGROUND OF THE INVENTION

The present invention relates to a patient bed comprising bed legs or bed base frame resting against the floor, a bed framework and a mattress, said mattress being comprised of adjacent elongated mattress elements, and said bed framework comprising the framing of the patient bed to which framing are fixed bars or similar tubular slat elements forming an essentially horizontal plane in which each tubular slat is aligned to essentially coincide in the crosswise direction of the patient bed with the corresponding furrow adapted between each pair of two adjacent mattress elements.

Beds of the above-described type are particularly used in hospitals, outpatient wards and similar premises. Patient beds have gradually been complemented with a number of useful auxiliary functions such as a variable-pitch back for elevating the patient to a sitting posture. However, a problem has been therein that when changing the bedclothes, for instance, on a bed supporting bedridden patient, at least two nurses are usually needed for lifting the patient. Moreover, such a lifting operation poses a risk of back injury to the lifting nurse.

FI patent 86,956 discloses a possible solution to the above-described problem. In this embodiment, the mattress is provided with furrows and an elevator grating adapted to the bed having bars aligned at the mattress furrows, whereby the bars will be hidden in the mattress furrows when the grating is in its lower position. The elevator grating serves for lifting the patient upward off from the plane of the mattress thus making the changing of the sheets easy. As such the arrangement is a good approach, but the elevation of the elevator grating and the patient resting thereupon consumes an unnecessarily high amount of energy.

It is an object of the present: invention to achieve a patient bed which is superior to the prior art and easier to use.

The invention makes the handling of the patient easier than in the prior art. The use of the patient bed is extremely simple and none of the routine operations require more than one nurse.

BRIEF DESCRIPTION OF THE FIGURES

In the following the invention will be examined in more detail with reference to the attached drawings, in which.

DETAILED DESCRIPTION OF THE PREFERRED EMBODIMENTS

Figure 1:
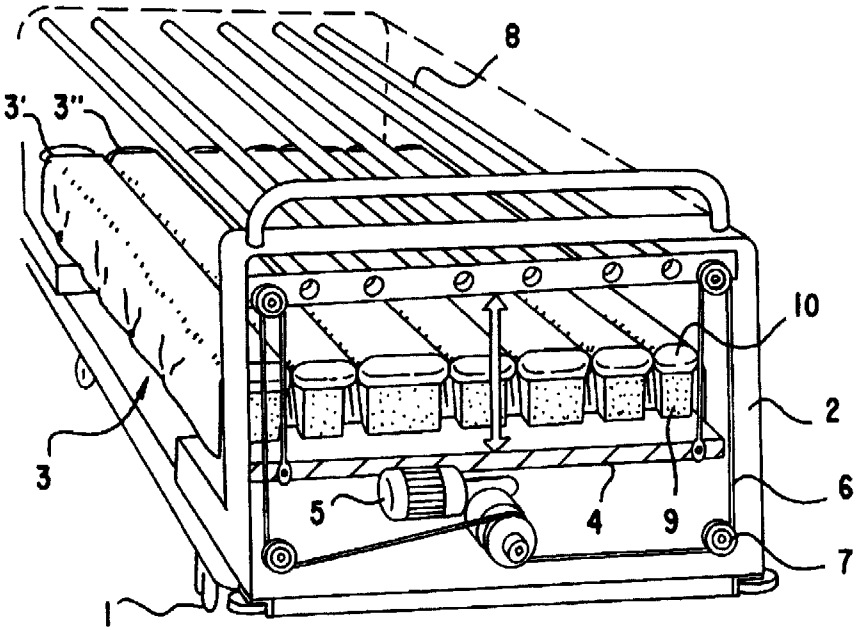
FIG. 1 is a diagrammatic, oblique, partial end view of a patient bed according to the invention.

FIG. 1 shows partially a patient bed according to the invention in an oblique end view of the bed. The bed comprises castors 1 resting against the floor, a bed framework 2 and a mattress 3. The mattress further comprises a number of mattress elements 3', 3", etc., aligned parallel in the longitudinal direction of the bed. The mattress elements are fixed to a platform 4 placed under the elements, said platform and thus also the mattress fixed to it being vertically movable by means of a actuator mechanism connected to the platform, which actuator mechanism in the embodiment illustrated in FIG. 1 comprises an electric motor 5, a rope/cable or chain 6, and deflection sheaves or chain sprockets 7, which are located essentially at the corners of the bed framework. The elevation and lowering of the platform 4, and thus the mattress 3 fixed to it, may also be implemented by means of an actuator cylinder or similar suitable device/mechanism.

Figure 4:
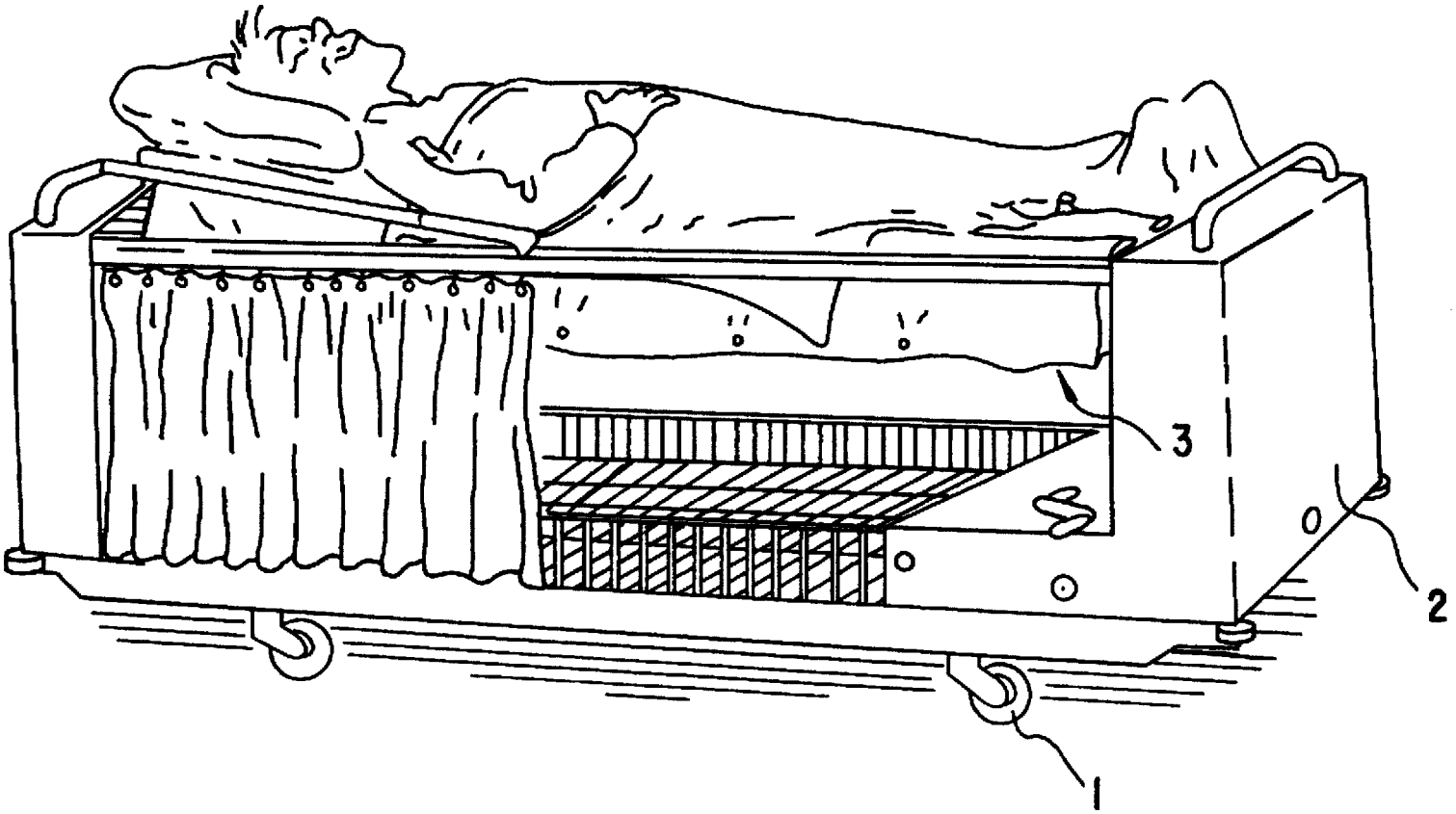
FIG. 4 is an oblique side view of the patient bed in a still further operating position.

To the patient bed framework 2 are attached tubes 8 or similar slat elements, which are aligned parallel to the mattress elements 3', 3" etc. so that they typically form an essentially horizontal plane, whereby each tubular slat is aligned to essentially coincide with the furrow adapted between the mattress elements in the crosswise or longitudinal direction of the bed. In the situation illustrated in FIG. 4, the mattress 3 is shown elevated to its upper position in which the platform 4 under the mattress elements will be essentially resting against the tubular slats 8. This is the normal position of the patient bed. As mentioned above, the actuator mechanism connected to the platform 4 makes it possible to lower the mattress downward by, e.g., approx. 30–50 cm (FIG. 1). In this position, however, the tubular slats 8 remain stationary.

As shown in FIG. 1, each mattress element includes a cushion portion 9 made from polyester foam or other suitable material and an air-filled portion 10 above the cushion portion. When desired, the foam-material cushion portion 9 can be easily replaced by another cushion of harder or softer material via an opening provided to the end of the mattress element. Alternatively, the air pressure in the air-filled portion 10 may be varied as required to adjust the mattress properties suitable to user preferences.

Figure 2:
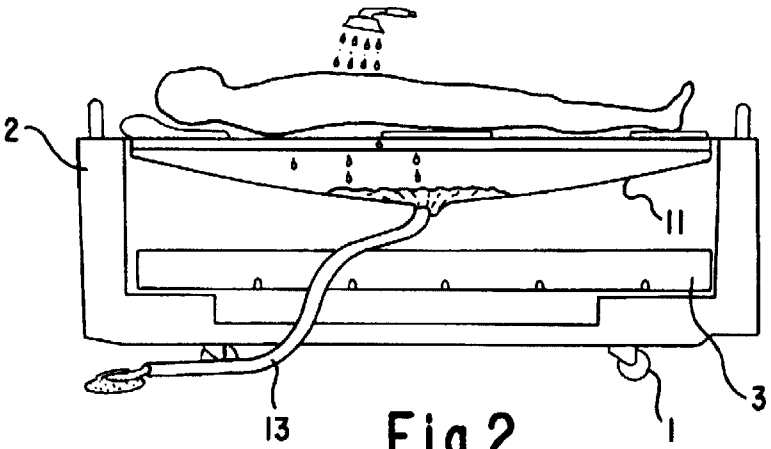
FIG. 2 is a side view of the patient bed in one of its operating positions.

A vertically movable mattress is particularly advantageous when the patient is to be washed (FIG. 2) or the sheets changed. Then, the mattress 3 is lowered by means of the actuator mechanism so that the patient remains resting on the tubular slats 8. The mattress is lowered so low that a space is provided between the mattress and the tubular slats large enough to facilitate the placing of a washing sheet 11 or similar impermeable cloth suited for collecting the runoff liquids resulting from the washing procedure. The bottom of the washing sheet may be provided with a drainage hole through which the washings can be taken further away via, e.g., a hose 13. Also the changing of a new bottom sheet on the mattress is easy when the mattress is lowered into its lower position. After all required nursing operations are completed, the mattress 3 is again elevated supported by the platform 4 so that the tubular slats 8 will be concealed by furrows remaining between the mattress elements.

Figure 3:
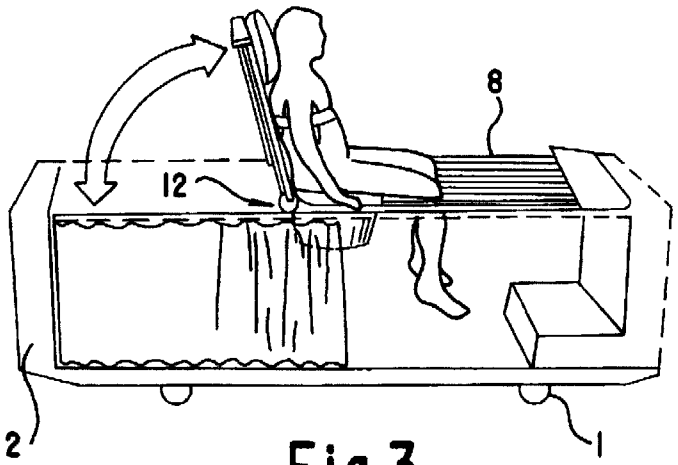
FIG. 3 is an oblique side view of the patient bed in another operating position.

The mattress 3, as well as the platform 4 supporting it, are "split" in two parts. Similarly, the tubular slats 8 are divided in two parts at the same point 12. For this purpose, longitudinally movable locking/pivot bars (not shown) are inserted to the interior of the tubular slats. The bars are normally in a position where they lock both parts of the tubular slats into a stiff slat at the pivot point 12. However, when desired, the locking bars can be withdrawn by means of a connecting beam (not shown) to a position in which the pivot point on the bars coincides with the pivoting joint 12 of the tubular slat halves. Then, the "pillow end" comprised by the tubular slat halves 8, the platform 4 and the mattress 3 can be pitched up (FIG. 4) to facilitate, e.g., a reading position for the patient. Such a pitching operation may again be implemented by a conventional means known in the art such as an actuator cylinder or similar device. In FIG. 3 the mattress 3 is shown lowered to its lower position (mattress not shown) and only the pivoted halves of the tubular slats 8 are pitched in the upright position, whereby the patient is in the sitting position. This position can be used for, e.g., urination or defecation into a bedpan.

To a person versed in the art it is obvious that the invention is not limited by the illustrating embodiments described above, but rather, can be varied within the scope of the annexed claims. The actuator functions of the patient bed in the above-described embodiment are implemented with the help of an electric motor. However, such actuator functions may as well be performed manually by means of a crank lever or a similar mechanism, or alternatively, using a power tool such as an battery-powered drill or similar device. Broadly, the different elevation and pitching mechanisms may be implemented using a variety of methods.

I claim:

1. A patient bed comprising castors resting against a floor and operatively attached through bed legs or a bed base frame to a bed framework, a planar support movably supported within said framework, a plurality of elongated mattress elements fixed to said planar support and forming a first supporting surface, adjacent mattress elements forming a furrow therebetween; and said bed framework comprising a framing to which are attached tubular slats, aligned parallel with the mattress elements and forming an essentially horizontal plane and second supporting surface in which each slat is aligned with a furrow formed between the mattress elements, wherein the patient bed further comprises means connected to said planar support for moving the mattress essentially in the vertical direction between a first position wherein said first supporting surface is above the horizontal plane formed by said slats with said slats being positioned in the furrows formed between mattress elements and a second position wherein said first supporting surface is below the horizontal plane formed by said slats and for stopping the mattress at a desired elevation between said two positions.

2. A patient bed as defined in claim 1, wherein both the mattress and the planar support are split in two parts in a longitudinal direction of the bed at essentially the same point, whereby at least one of the parts is pitchable away from the normal plane of the mattress and the planar support by virtue of a pivoting and pitching mechanism adapted to said pivoting point.

3. A patient bed as defined in claim 1, wherein the elements of the mattress comprise a lower portion made from an essentially resilient material and an upper portion adapted to be fillable with a gas.

4. A patient bed as defined in claim 1, wherein said means for moving comprise an electric motor and an actuator mechanism suited for moving the entity formed by the mattress and the planar support.

* * * * *